US011686541B2

(12) United States Patent
Pokalyaev et al.

(10) Patent No.: US 11,686,541 B2
(45) Date of Patent: Jun. 27, 2023

(54) AUTOMATIC FIREARM HAVING AN INERTIAL AUTOMATIC SYSTEM

(71) Applicants: Vasilij Mihajlovich Pokalyaev, Sverdlovskaya obl. (RU); Sergei Pokalyaev, Sverdlovskaya obl. (RU)

(72) Inventors: Vasilij Mihajlovich Pokalyaev, Sverdlovskaya obl. (RU); Sergei Pokalyaev, Sverdlovskaya obl. (RU)

( * ) Notice: Subject to any disclaimer, the term of this patent is extended or adjusted under 35 U.S.C. 154(b) by 260 days.

(21) Appl. No.: 17/262,709

(22) PCT Filed: Apr. 10, 2019

(86) PCT No.: PCT/RU2019/000228
§ 371 (c)(1),
(2) Date: Jan. 23, 2021

(87) PCT Pub. No.: WO2020/040659
PCT Pub. Date: Feb. 27, 2020

(65) Prior Publication Data

US 2021/0164743 A1 Jun. 3, 2021

(30) Foreign Application Priority Data

Aug. 21, 2018 (RU) ..... RU2018130425

(51) Int. Cl.
*F41A 3/82* (2006.01)

(52) U.S. Cl.
CPC ..... *F41A 3/82* (2013.01)

(58) Field of Classification Search
CPC ..... F41A 3/82; F41A 3/86; F41A 3/88
See application file for complete search history.

(56) References Cited

U.S. PATENT DOCUMENTS

| | | | | |
|---|---|---|---|---|
| 4,355,563 | A * | 10/1982 | Swieskowski | F41A 3/82 89/130 |
| 5,353,681 | A * | 10/1994 | Sugg | F41A 25/16 89/43.01 |
| 8,752,474 | B2 | 6/2014 | Vanek | |
| 2009/0101000 | A1* | 4/2009 | Rawson-Harris | F41A 3/62 89/190 |
| 2020/0200495 | A1* | 6/2020 | Weilharter | F41A 5/12 |
| 2022/0136787 | A1* | 5/2022 | Caudle | F41A 3/62 89/191.01 |

FOREIGN PATENT DOCUMENTS

| | | |
|---|---|---|
| RU | 2144171 C1 | 1/2000 |
| RU | 2241939 C1 | 12/2004 |
| RU | 2626771 C2 | 8/2017 |

* cited by examiner

*Primary Examiner* — J. Woodrow Eldred
(74) *Attorney, Agent, or Firm* — John Alumit

(57) ABSTRACT

An automatic firearm having an inertial automation system comprises a barrel, which is movable along its own axis, a bolt support with a bolt, a recoil spring, a buffer spring and a hammer spring, a trigger mechanism, an ammunition feed mechanism, a mechanism for coordinating the actual firing, and a bolt support latch. The springs and the mechanism for coordinating the actual firing ensure a constant-value recoil force during automatic fire. Technical result consists in the improvement of the shooter's operating conditions, reduced vibration, and decreased bullet dispersion.

1 Claim, 1 Drawing Sheet

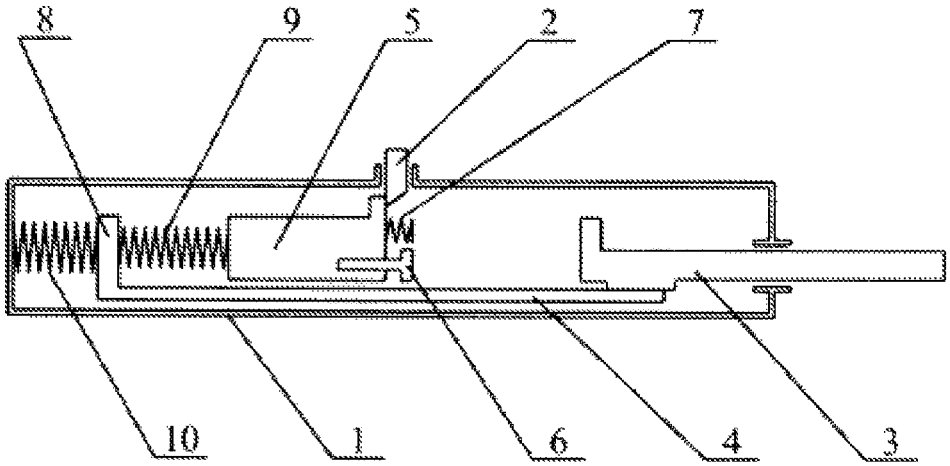
8
9
5
2
7
10
1
6
4
3

AUTOMATIC FIREARM HAVING AN INERTIAL AUTOMATIC SYSTEM

This invention relates to the field of military equipment and, specifically, to automatic firearms [F 41 C 7/00, F 41C 3/00, F 41 A 21/00].

The prior art describes an automatic firearm with the recoil in the form of a constant-value force (RU 2626771), which has been selected as a prototype.

An automatic firearm with the recoil in the form of a constant-value force comprises a breech; a barrel, which is movable along its own axis; a bolt support with a bolt; a hammer spring between the barrel and the bolt support; a recoil spring between the bolt support and the breech or barrel (a part, attached to the barrel); a buffer spring between the barrel (a part attached to the barrel) and the breech, where said buffer spring transmits a pulse to the barrel as the latter accelerates between its rear and forward positions, which is equal to one half of the pulse received by the barrel when a shot is fired; a trigger mechanism located on the breech, or bolt support, or barrel; an ammunition feed mechanism; a latch for locking the barrel in the rear position (the latch is controlled by a trigger guard); and a mechanism for coordinating the actual firing with the barrel arrival into the forward position.

The weapon operates as follows. Prior to opening automatic fire, the weapon is loaded, and the barrel is retracted into the rear position and latched, which causes the buffer spring to compress. When the trigger is pressed, the latch releases the barrel, which accelerates forward under the action of the buffer spring, and when the barrel is in the forward position, a shot is automatically fired. The stiffness of the buffer spring and the barrel recoil length are selected such that by the time of actual firing, the barrel could acquire a pulse equal to one half of the pulse received from firing a shot. Thus, in the process of firing a shot, the barrel stops and starts moving in the opposite direction, while having a pulse of the same magnitude as before the shot was fired. Subsequently, the buffer spring becomes compressed, and the barrel velocity decreases to zero as it reaches the rear position. Concurrently, the automation system reloads the weapon. If the barrel is not latched, it will move forward, and the sequence of the mechanism actions will be repeated. The automatic fire will continue until the barrel is latched (by releasing the trigger), or the ammunition runs out. Thus, during the entire duration of automatic fire, the barrel will be making reciprocating movements, while only pressing against the compressed buffer spring, which, in turn, will transmit the pressure to the breech in the form of a constant-value force, which reduces shaking, improves the weapon target-pointing conditions, reduces the bullet dispersion, and improves the crew operating conditions. The disadvantage of such technical solution is the uncertain, unstable operation, especially with an inertial automation system.

The objective, which the proposed invention intends to achieve is to create a design of an automatic firearm having an inertial automation system, which would ensure a recoil in the form of a constant-value force acting on a support (shooter's shoulder, weapon mount, combat vehicle body) for the entire duration of automatic fire, with the possibility to use such design in all types of automatic firearms (stationary, mounted, portable, hand-held).

The technical result achieved by the provided set of features consists in obtaining a weapon recoil in the form of a constant-value force acting on the support (shooter's shoulder, weapon mount, combat vehicle body) for the entire duration of automatic fire, which eliminates weapon shaking, improves the shooter's operating conditions and weapon target-pointing conditions, and reduces the bullet dispersion. The invention can be applied to all types of automatic firearms (stationary, mounted, portable, hand-held).

This objective and the technical result are achieved by providing a firearm with a breech; a barrel, which is movable along its own axis; a bolt support with a bolt; a hammer spring between the barrel and the bolt support; a recoil spring between the bolt support and the breech or barrel (a part, attached to the barrel); a buffer spring between the barrel (a part attached to the barrel) and the breech; a trigger mechanism located on the breech, or bolt support, or barrel; an ammunition feed mechanism; a latch for locking the barrel in the rear position (the latch is controlled by a trigger guard); a mechanism for coordinating the actual firing with the barrel arrival into the forward position (immediately before colliding with the barrel via the hammer spring); aiming devices; and a stock. While performing its reciprocating movements, the barrel should not hit the breech. If necessary, the barrel can be provided with softening, damping, shock absorbing, or other devices. When installing the recoil spring between the bolt support and the breech, the bolt support rollback in the rear position should be restricted by hitting the barrel (a part, attached to the barrel). The elastic force of the recoil spring should be approximately the same as the force created by the weapon when pressing against the support during automatic firing. The required rate of fire and barrel pulse compensation (stopping the barrel or, if required by the design, moving it forward or backward at a certain rate) after firing a shot and achieving elastic collision between the barrel and the bolt support should be ensured by selecting a mass of the barrel and bolt support, as well as the travel length of the bolt support, and other parameters. If the barrel pulse compensation is either insufficient, or excessive, the buffer spring will adjust for the difference by accelerating the barrel forward (insufficient compensation) or backward (excessive compensation) before firing a shot.

The weapon operates as follows. Before opening automatic fire, the weapon is loaded. The bolt support is retracted into the rear position and latched, which causes the recoil spring to compress. If required by the design, the same action can be used to also compress the buffer spring. When the trigger is pressed, the latch releases the bolt support, which accelerates forward assisted by the recoil spring; a cartridge is fed into the cartridge chamber; the bolt closes; the shot is automatically fired immediately before the bolt support collides with the barrel; the barrel starts moving backward as a result of recoil and collides with the bolt support via the hammer spring; the barrel stops, while the bolt support, having received an additional energy from the barrel, moves backward and compresses the recoil spring; the bolt opens; the empty cartridge is ejected from the cartridge chamber and the trigger mechanism is cocked. Unless the trigger is released, which will cause the latch to lock the bolt support in the rear position, the mechanism actions will be repeated The automatic fire will continue until the bolt support is latched, or ammunition runs out.

Thus, during the entire duration of automatic fire, constant-value forces will be applied to the breech by both the reciprocating barrel (via the buffer spring) and the bolt support (via the recoil spring).

As an example, the drawing (FIG. 1) illustrates the design, which utilizes the inertial automation system while associating the bolt support (with the bolt) and the barrel. A weapon breech (1) houses a latch (2), and a barrel (3), which is movable along its own axis. A guide (4) is attached to the barrel, and bolt support (5) with bolt (6) is movably attached to said guide. A hammer spring (7) is attached to the bolt support. A recoil spring (9) is installed between the bolt support and a guide stop (8), while a buffer spring (10) is installed between the guide stop and the rear wall of the breech. The order of operation of the design is similar to the one described above.

According to the calculations, in case of the automatic firing rate of 600 rounds per minute, a near-constant force pressing on the support (shooter's shoulder, weapon mount, combat vehicle body) will be as follows (newtons/kilogram-force) for the cartridges: 5.45×39-35/3.6; 7.62×39-55/5.6; 7.62×54R-90/9.2; 12.7×108-400/41; 14.5×114-650/66.

The pressing force increases or decreases proportionally with an increase or decrease in the rate of fire.

We claim:

1. An automatic firearm having an inertial automation system with recoil throughout the entire time of automatic fire having a force of a certain constant value acting on a support, comprising a breech; a barrel, which is movable a longitudinal axis; a bolt support with a bolt; a hammer spring between the barrel and the bolt support; a recoil spring between the bolt support and a guide stop; a buffer spring between a rear wall of the breech and the guide stop; an ammunition feed mechanism for loading of ammunition into the firearm wherein said loading causes the bolt support to retract and attach to a latch for locking the bolt support in a rear position, a trigger mechanism that, when pressed, causes the latch to release the bolt support which accelerates forward in the direction of the barrel assisted by the recoil spring.

* * * * *